United States Patent [19]

Wiggershaus et al.

[11] 4,227,679

[45] Oct. 14, 1980

[54] HOIST WITH TWO OR MORE HOISTING UNITS

[75] Inventors: Fred Wiggershaus, Gevelsberg; Felix Schäfer, Wetter, both of Fed. Rep. of Germany

[73] Assignee: Mannesmann Demag A.G. Wolfgang-Reuter-Platz, Duisburg, Fed. Rep. of Germany

[21] Appl. No.: 21,909

[22] Filed: Mar. 19, 1979

[30] Foreign Application Priority Data

Mar. 23, 1978 [DE] Fed. Rep. of Germany ..... 2812687

[51] Int. Cl.[3] ..... B66D 1/26

[52] U.S. Cl. ..... 254/270; 254/277; 254/264

[58] Field of Search ..... 254/184, 185 R, 185 B, 254/141, 172, 173 R; 212/8 A, 9, 83, 97, 135

[56] References Cited

U.S. PATENT DOCUMENTS

| | | | |
|---|---|---|---|
| 3,265,360 | 8/1966 | Tax | 254/184 X |
| 3,273,860 | 9/1966 | Weisenbach | 254/184 |
| 3,618,897 | 11/1971 | Swoboda et al. | 254/172 |
| 3,743,107 | 7/1973 | Verschoof | 254/184 X |
| 4,126,298 | 11/1978 | Lub | 254/172 |

FOREIGN PATENT DOCUMENTS

| | | |
|---|---|---|
| 2115587 | 10/1972 | Fed. Rep. of Germany . |
| 27649 | 3/1964 | German Democratic Rep. . |

OTHER PUBLICATIONS

Hebezeuge und Fordermittel, 14 (1974) H. 11.

*Primary Examiner*—John M. Jillions
*Attorney, Agent, or Firm*—Mandeville and Schweitzer

[57] ABSTRACT

A multi-unit hoist apparatus is provided having an overload arrangement in the form of reversible pressure medium cylinders connected to the fixed end of each hoist unit in the apparatus. Appropriate controls are incorporated into the pressure medium supply to each unit, whereby if the load becomes unbalanced the unit subjected to an overload is relieved when the overload reaches a specific preset level.

7 Claims, 1 Drawing Figure

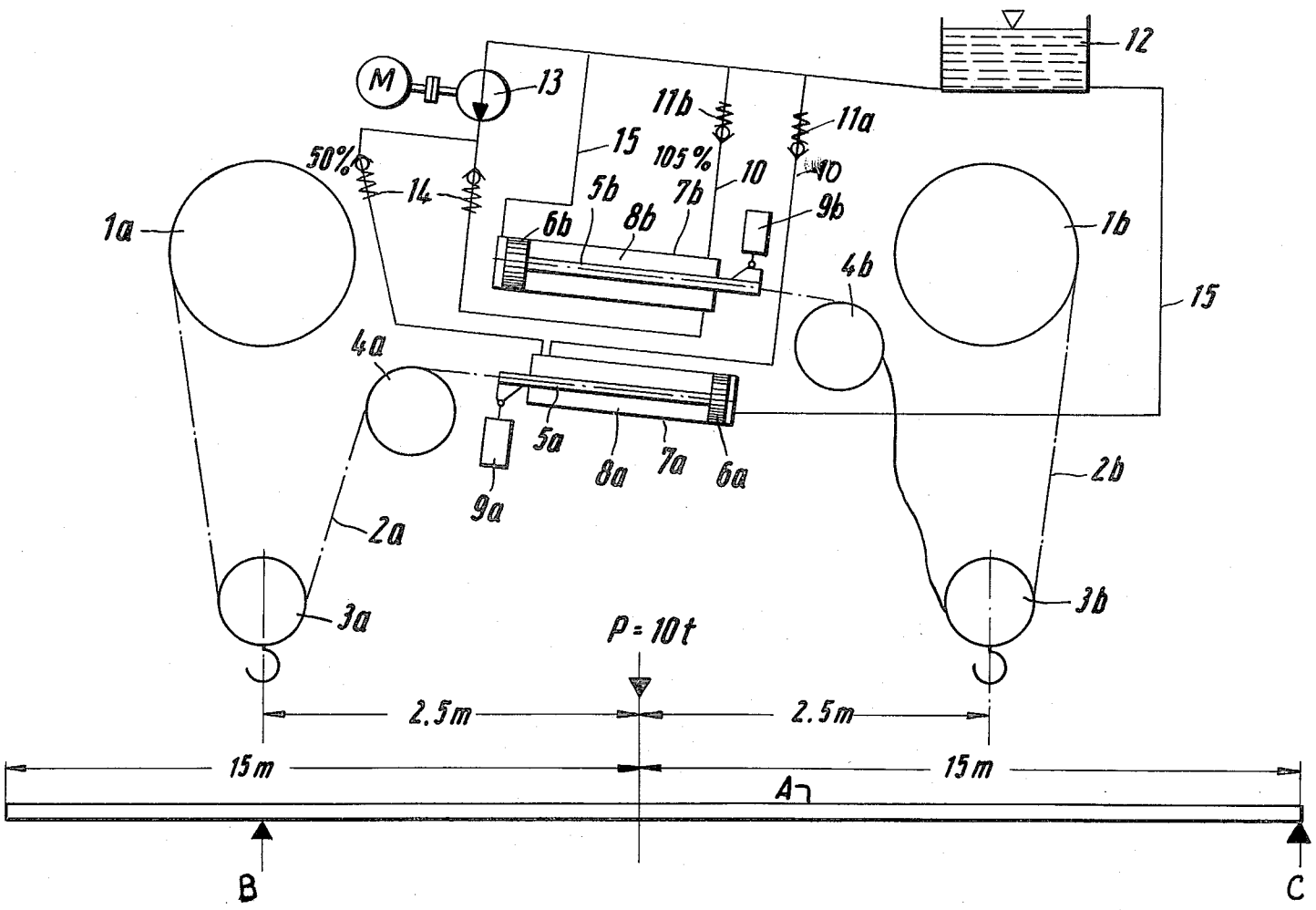
12
15
1b
2b
3b
11a
D
9b
4b
10
105%
7b
11b
15
8b
5b
6b
13
M
14
50%
1a
4a
2a
3a
6a
7a
8a
5a
9a
P=10t
2.5m
2.5m
15m
15m
A
B
C

HOIST WITH TWO OR MORE HOISTING UNITS

BACKGROUND AND STATEMENT OF THE INVENTION

The invention refers to a hoist with at least two hoisting units, with the hoisting cables or similar means of each unit extending around guide pulleys of lower or sub-pulleys to fixed points on the hoist body.

A hoist disclosed in German DE-OS No. 2 115 587 shows four hoisting units for one container with the vertical position thereof checked by a measuring device under the hoist. There are no devices preventing an overload during uneven contact with a separate support. This is of no particular disadvantage in the hoist shown in that publication, since the hoisting units engage near the four corners of the load. Thus, an uneven support cannot cause any notable overloads of one hoisting unit. Considerable overloads may occur, however, when setting down a load, if the latter was lifted by several spaced hoist units, and the load extends considerably beyond the working points of the hoist units.

It is, therefore, the object of the invention to provide a hoist with several hoisting units to transport loads, which loads may protrude far beyond the attaching points of the hoisting units in such a manner that an overload of the hoisting units is safely prevented. The device of the invention operates effectively even if the load has already made contact with an underlying support at the end opposite the hoisting unit. This is done by providing the hoisting cable of each hoisting unit with a piston cylinder arrangement, one part of which, e.g. the cylinder, may be attached to the hoist body, while the other part, namely the piston rod, may serve as the fixed or holding point or end of the hoisting cable with the hoisting unit being at the other end. The pressure chamber of the cylinder is connected to a common pressure medium system for all hoisting units via an overload check valve for exhausting the pressure chamber during excessive pressure. The extent of a possible overload is explained later in an example.

The occurrence of an overload is prevented by the overload check valve which is preferably set for a 5% overload, permitting the pressure medium to flow out of the pressure chamber of the cylinder upon the pressure reaching 5% overload, so that the fixed point of the cable yields in a sinking or lowering direction. The working distance or stroke of the piston compensates for a possible vertical elevational difference, and the displaced pressure medium flows into the pressure medium system which is equipped with an accumulator for receiving the pressure medium.

In order to prevent slack in the cable, all hoisting units are disconnected as soon as one of the overload check valves responds, and to this end each piston is equipped with a switch. Another feature of the invention provides a pressure medium pump in the pressure medium circuit for resetting so as to move the piston in a withdrawing direction, such pump feeding pressure medium into reduced-volume pressure chambers via an infeed check valve opening in the direction of the cylinder pressure chamber.

An example of the invention is shown in the drawing, which is a schematic view of the hoisting mechanism, and explained as follows.

DETAILED DESCRIPTION OF THE INVENTION

Hoisting cables 2a and 2b lead from the two hoisting units 1a and 1b respectively, around lower pulleys 3a and 3b whose load hooks carry beam A of 30 m length, via guide pulleys 4a and 4b, again respectively, to piston rods 5a and 5b of pistons 6a and 6b in cylinders 7a and 7b. The pressure chambers 8a and 8b of cylinders 7a and 7b are connected to a pressure medium accumulator 12 via pressure medium lines 10 and overload check valves 11a and 11b. Pump 13 pumps the pressure medium into the reduced-volume pressure chambers 8a and/or 8b via one of the infeed check valves 14, after shifting of one of the pistons 6a or 6b. A return line 15 to the pressure medium accumulator 12 leads from each pressure chamber of cylinder 7a, 7b between the piston and the cylinder floor. The return line 15 may be identical with the line between the pressure medium accumulator 12 and pump 13 and/or overload check valves 11a and/or 11b.

If, for example, beam A transported by hoisting units 1a and 1b sets down first on the right, the load of hoisting unit 1a is increased due to the altered lever ratios between the center of gravity of the beam and its working points B and C. Hoisting cable 2a pulls piston 6a from cylinder 7a, and allows the pressure medium to flow into pressure medium accumulator 12 via overload check valve 11a set for 5% above load. Then, switch 9a attached to piston rod 5a disconnects the two hoisting units 1a, 1b and prevents slack in the cable at hoisting unit 2b. Cable 2a pulls piston rod 5a from cylinder 7a until load A has touched base to the left of the center of gravity as well.

When the load, which was set down at a slant, is lifted, it will retain its inclination at first until it is suspended from both hoisting units under an even load. Then pump 13 may be started and both pressure chambers are charged evenly via the infeed check valves 14, whereby piston 6a in cylinder 7a is pressed against the cylinder floor. During this process load A resumes a horizontal position again.

During lifting of the load, the overload safety device may be activated as well, if the load moves against an obstacle from below, for example. For overload in the hoisting unit, the piston is pulled out of the cylinder and the switch disconnects both hoisting units, which may then be shifted to lower the load to remove it from under the obstacle.

As an example, the overload safeguard prevents the following overload, with measurements and weights as recorded in the drawing:

$$A = \frac{10\,t \times 15}{(15 + 2.5)} \text{ approx. } 8.6\,t$$

wherein t.=tons. Since the normal load of a hoisting unit amounts to 5 tons, the overload amounts to approximately 3.6 t, i.e. about 70% which is not permissible.

We claim:

1. A multi-unit hoist apparatus comprising
(a) a hoist body;
(b) a plurality of hoist units disposed on said body;
(c) a cable extending from each hoist unit to a point on said body;
(d) a load support suspended from each cable of each unit; the improvement characterized by (e) a reversible pressure medium unit disposed in each cable adjacent said hoist body;

(f) the end of each said cable opposite its respective hoist unit connected to the piston rod of its respective pressure medium unit;

(g) a supply of pressure medium;

(h) flow communication means between said supply and each said reversible pressure medium unit; and (i) an overload check valve in said flow communication means for each said pressure medium unit;

(j) each said overload check valve preset to allow pressure medium flow between each individual unit to said source, if overloaded.

2. The apparatus of claim 1, further characterized by (a) each said overload check valve is preset for a 5% overload.

3. The apparatus of claim 1, further characterized by (a) each said overload check valve is preset to respond to 105% of the respective lifted load of its related pressure medium unit.

4. The apparatus of claim 1, further characterized by (a) means in said flow communication means for switching off all said hoisting units when one unit is overloaded.

5. The apparatus of claim 4, further characterized by (a) said switching off means is a switch connected to and responsive to movement of the piston rod of each said reversible pressure medium unit.

6. The apparatus of claim 1, further characterized by (a) said source includes a pressure medium accumulator.

7. The apparatus of claim 1, further characterized by said flow communication means including (a) a pressure medium pump for supplying pressure fluid medium to each said pressure medium unit;

(b) infeed pressure medium lines from said pump to each said pressure medium unit; and (c) a one-way check valve in each said infeed pressure medium line opening toward each said unit.

* * * * *